United States Patent [19]

Sato et al.

[11] Patent Number: 4,719,198

[45] Date of Patent: Jan. 12, 1988

[54] HEAT-SENSITIVE RECORDING SHEET

[75] Inventors: Masuhiko Sato; Toshimi Satake, both of Tokyo, Japan

[73] Assignee: Jujo Paper Co., Ltd., Tokyo, Japan

[21] Appl. No.: 870,453

[22] Filed: Jun. 4, 1986

Related U.S. Application Data

[63] Continuation-in-part of Ser. No. 382,341, May 26, 1982, abandoned.

[30] Foreign Application Priority Data

Jun. 4, 1981 [JP] Japan ..... 56-85011

[51] Int. Cl.[4] ..... B41M 5/18

[52] U.S. Cl. ..... 503/209; 427/150; 427/151; 503/208; 503/216; 503/217; 503/221; 503/225

[58] Field of Search ..... 346/208, 207, 209, 216, 346/217, 225; 427/150–152; 503/207–209, 216, 217, 221, 225

*Primary Examiner*—Bruce H. Hess

*Attorney, Agent, or Firm*—Koda and Androlia

[57] ABSTRACT

A heat sensitive recording sheet including p-benzyloxybenzoic acid benzylester and filler in its color-forming layer which contains a basic colorless or pale-colored chromogenic dyestuff and an organic color-developing agent whereby a heat sensitive recording sheet having a highly stable developed image against oily substances such as hair oil, sweat, etc. is provided without deteriorating the fundamental qualities of the heat sensitive recording sheet.

6 Claims, No Drawings

HEAT-SENSITIVE RECORDING SHEET

This is a continuation-in-part of application Ser. No. 382,341, filed May 26, 1982, now abandoned.

BACKGROUND OF THE INVENTION

1. Field of the Invention

The present invention relates to a heat sensitive recording sheet having excellent color forming properties and high stability of the developed image against oily substances such as hair, oil, sweat, etc.

2. Prior Art

A heat sensitive recording sheet that utilizes a thermal color-forming reaction occurring between colorless or Pale-colored chromogenic dyestuff and phenolic material, or organic acid is disclosed, for example, in Japanese Patent Publication No. 4,160/1968 and No. 14,039/1970 and in Japanese Laid-Open Patent Application No. 27,736/1973 and is now in wide practical use.

In general, a heat sensitive recording sheet is produced by applying to the sheet surface a coating which is prepared by individually grinding and dispersing colorless chromogenic dyestuff and color-developing material, such as phenolic substance into fine particles, mixing the resultant dispersions with each other and then adding thereto binder, filler, sensitizer, slipping agent and other auxiliaries. When this sheet is heated, the coating instantly undergoes a chemical reaction which forms a color. In this case, various bright colors can be advantageously formed depending upon the selection of specific colorless chromogenic dyestuff.

These heat sensitive recording sheets have found a wide range of applications including medical or industrial measurement recording instruments, terminal printers for computers and information communication systems, facsimile equipment, printers for electronic calculators, automatic ticket vending machines and so on.

On the other hand, heat sensitive recording sheets come continuously into contact with human hands. At this time, oily substances such as hair oil. sweat, etc., adhering to the hands and fingers of the operators, often transfers to and contaminates the heat sensitive recording sheet. Generally, heat sensitive recording papers have not have sufficient stability against the oily substances so that there is a phenomenon that the color image density of contaminated parts is reduced or disappears and in that contamination of the background causes discoloration. Such a lack of stability against the oily substances is disadvantageous to the role and function of information recording paper.

Ideally, it is required that a heat sensitive recording paper develop a clear recording in high image-density, exhibit no recording problems due to the adhesion of accumulated residues onto the thermal head, sticking, etc., and has improved quality such as less decline in brightness with elapsed time. In addition, it is required that the heat sensitive paper have excellent stability of the recorded image and background against the oily substances such as hair oil, sweat, etc. The reason why contamination due to hair oil, sweat, etc. causes the reduction of density or the disappearance of a developed image and the deterioration of the background is unknown. However, it is assumed that the derivatives of glycol and the oily substances which are contained in hair oil, sweat, etc. dissolve or partly instabilize the reaction product of the chromogenic dyestuff and organic color-developing agent; in the case of deterioration of the background, the oily substance will instabilize the color-forming layer composed of chromogenic dyestuff and organic color-developing agent.

SUMMARY OF THE INVENTION

Accordingly, it is the general object of the present invention to provide a heat sensitive recording sheet which has both excellent color forming properties (improvement of accumulated residue, color density and sticking) and a high stability of developed image against oily substances such as hair oil, sweat, etc. without deteriorating its fundamental qualities.

The above-mentioned object can be performed by using color-forming layer which comprises 3–10 parts by weight of organic color-developing agent, 1–8 parts by weight of p-benzyloxybenzoic acid benzylester and 1–20 parts by weight of filler per 1 part by weight of chromogenic dyestuff and 10–25 parts by weight of a binder per total solid content thereof.

DETAILED DESCRIPTION OF THE INVENTION

The p-benzyloxybenzoic acid benzylester is obtained as a byproduct by forming ether-bond at hydroxygroup, when p-hydroxybenzoic acid benzylester as color-developing agent in a heat-sensitive recording sheet is synthesized by a reaction between p-hydroxybenzoate (Potassium salt or Sodium salt) and benzylchloride.

Therefore, p-benzyloxybenzoic acid benzylester is regarded as an unnecessary product. The yield of p-hydroxybenzoic acid benzylester is low due to the formation of p-benzyloxybenzoic acid benzylester, so that the device for preventing this byreaction or the process for removing this byproduct is required.

It has been found that the use of both p-benzyloxybenzoic acid benzylester as a byproduct and a color developing agent such as bisphenol, etc. causes the stabilization against oily substances.

Particularly, the use of p-benzyloxybenzoic acid together with p-hydroxybenzoic acid benzylester as color-developing agent causes a considerable stabilization of color-developing against oily substances.

In this case, p-hydroxybenzoic acid benzylester can be controlled to a desired ratio, and both chemicals can be used under a mixed state which is advantageous in costs.

Further, p-benzyloxybenzoic acid benzyl ester can be synthesized alone or can be obtained by the separation of the byproduct. The obtained benzyloxybenzoic acid benzyl ester can be used, if desired, together with various color-developing agents.

Furthermore, in the present invention, it is suitable to use 3–10 parts by weight of organic color developing agent, 1–8 parts by weight of p-benzyloxybenzoic acid benzylester and 1–20 parts by weight of filler per 1 part by weight of chromogenic dyestuff and to add 10–25 parts by weight of a binder per total solid content.

The colorless or pale-colored dyestuffs of the present invention are not particularly limited and are, for example, as follows: crystal violet lactone (blue), 3-diethylamino-6-methyl-7-anilinofluoran (black), 3-(n-ethyl-p-toluidino)-6-methyl-7-anilinofluoran (black), 3-diethylamino-6-methyl-7-(o,p-dimethylanilino) fluoran (black), 3-pyrrolidino-6-methyl-7-anilinofluoran (black), 3-piperidino-6-methyl-7-anilinofluoran 3-(n-cyclohexyl-n-methylamino)-6-methyl-7-anilinofluoran (black), 3-diethylaminio-7-(o-chloro-anilino) fluoran (black), 3-diethylamino-7-(m-trifluoromethylanilino) fluoran (black), 3-diethylamino-6-methylchlorofluoran (red), 3-diethylamino-6-methylfluoran (red), and 3-cyclohexylamino-6-chlorofluroan (orange).

On the other hand, examples of organic color-developing agents are organic carboxylic acids or phenols such as bisphenol A (4,4'-isopropylidene diphenol), p,p'(1-methylnormal -hexylidene)diphenol, p-tertiary butylphenol, p-phenylphenol, Novolak phenolic resin, p-hydroxybenzoic acid esters and so on. Such organic color-developing agents are employed singly or together depending upon the usage and the required performance.

The above-mentioned organic color-developing materials, chromogenic dyestuffs and p-benzyloxybenzoic acid benzylester are ground down to a particles size of several microns or smaller by means of a grinder or emulsifier such as a ball mill, attritor, sand grinder, etc. and filler is added. Examples of filler are inorganic or organic fillers such as kaolin calcined kaolin, diatomaceous earth, talc, titanium dioxide, calcium carbonate, magnesium carbonate, aluminium hydroxide, etc. And in accordance with the purpose, various additives are added thereto to prepare coating colors. Such additives are as follows: binders such as polyvinylalcohol, modified polyvinylalcohol, hydroxyethyl cellulose, methyl cellulose, starches, styrene-maleic anhydride copolymer, vinly-acetate-maleic anhydride-copolymer, styrene-butadiene-copolymer, etc.; if desired, releasing agent such as metal salts of fatty acids, etc.; slipping agent such as waxes, etc.; UV-absorbers such as benzophenone type or triazole type; water-resistance agent such as glyoxal, etc.; dispersants; antifoamers; etc.

The heat sensitive recording sheet suitable for the purpose can be obtained by applying paper or various films with these coating colors.

In the present invention it is suitable to use 3–10 parts by weight of organic color-developing agent, 1–8 parts by weight of p-benzyloxybenzoic acid benzylester and 1–20 parts by weight of filler per 1 part by weight of chromogenic dyestuff and to add 10–25 parts by weight of a binder per total solid content. Paper, film, foil, etc. may be used as the base sheet of the present invention.

Hereinafter, the present invention will be described further by way of typical examples of preferred embodiments thereof and by reference examples.

EXAMPLE 1

| | |
|---|---|
| Solution A (dispersion of dyestuff) | |
| 3-diethylamino-6-methyl-7-amilinofluoran | 1.5 parts |
| 10% aqueous solution of polyvinyl alcohol | 3.4 parts |
| water | 1.9 parts |
| Solution B (dispersion of color-developing agent) | |
| p-hydroxybenzoic acid benzylester | 6.0 parts |
| zinc stearate | 1.5 parts |
| 10% aqueous solution of polyvinyl alcohol | 18.8 parts |
| water | 11.2 parts |
| Solution C | |
| p-benzyloxybenzoic acid benzylester | 1.0 parts |
| 10% aqueous solution of polyvinyl alcohol | 2.5 parts |
| water | 1.5 parts |

The solutions A, B and C of the above-mentioned composition were individually ground to a particle size of 3 microns by ball mill. Then, the dispersions were mixed in the following portions to prepare the coating colors.

| COATING COLORS | Examples of the Present Invention | Reference Examples |
|---|---|---|
| Solution A | 9.1 parts | 9.1 parts |
| Solution B | 37.5 parts | 37.5 parts |
| Solution C | 5.0 parts | 0 parts |
| Kaolin Clay | 10.0 parts | 10.0 parts |

(50% aqueous dispersion)

The coating colors were applied on one side of a base paper weighing 50 g/m$^2$ at a coating weight of 6.0 g/m$^2$ and were dried. The resultant papers were treated to a smoothness of 200–300 seconds by a supercalender. The obtained black-color-forming heat sensitive recording papers were tested for their quality and performance and the test results are shown in Table 1.

TABLE I

| | Image Density at 105° C. (1) | Image Density after Contamination with Hair-Liquid (2) | Residual Ratio of Image Density after the Contamination (3) |
|---|---|---|---|
| Example of the Present Invention | 1.17 | 1.16 | 99.2% |
| Reference Example | 1.18 | 0.58 | 49.2% |

Note:

(1) The heat sensitive recording sheets are pressed down for five seconds under a pressure of 10 g/cm$^2$ on a hot plate and the optical density of the developed image is measured by the MacBeth densitometer RD-104.

(2) A hair liquid ("Bravas" manufactured by Shiseido Company, Limited) is sucked up into an injector. A drop of the hair liquid is forced out from the injector to a forefinger, and spread on the forefinger with the thumb, and transferred from the forefinger to the surface of the heat sensitive recording-sheet which was colored. The optical density of the image is measured by the MacBeth densitometer (RD-104) ten days after the contamination with the hair liquid.

(3) Residual ratio of the Image density after the contamination =

$$\frac{\text{Image density after the contamination}}{\text{Image density at 105° C.}} \times 100$$

As is obvious from Table 1, the Examples of the present invention containing the combination of p-benzyloxybenzoic acid benzylester with filler has a residual ratio of image density of 99.2% and hence provides a relatively stable image for the contamination with a hair liquid. On the contrary, the Reference Example without the combination of p-benzyloxybenzoic acid benzylester with filler has a remarkable reduction in image density. Therefore, the present invention provides excellent effect against contamination with oily substances.

EXAMPLE 2

| | |
|---|---|
| Solution A (dispersion of dyestuff) | |
| 3-pyrrolidino-6-methyl-7-anilofluoran | 1.5 parts |
| 10% aqueous solution of polyvinyl alcohol | 3.4 parts |
| water | 1.9 parts |
| Solution B (dispersion of color-developing agent) | |
| Bisphenol A (4,4'-isopropylidene diphenol | 6.0 parts |
| zinc stearate | 1.5 parts |
| 10% aqueous solution of polyvinyl alcohol | 18.8 parts |
| water | 11.2 parts |
| Solution C | |
| p-benzyloxybenzoic acid benzylester | 1.0 parts |
| 10% aqueous solution of polyvinyl alcohol | 2.5 parts |
| water | 1.5 parts |

The solutions A, B and C of the above-mentioned composition were individually ground to a particle size of 3 microns by an attritor. Then, the dispersions were mixed in the following portions to prepare the coating colors.

| COATING COLORS | Examples of the Present Invention | Reference Examples |
|---|---|---|
| Solution A | 9.1 parts | 9.1 parts |
| Solution B | 37.5 parts | 37.5 parts |
| Solution C | 5.0 parts | 0 parts |
| Kaolin Clay | 10.0 parts | 10.0 parts |

(50% aqueous dispersion)

The coating colors were applied on one side of a base paper weighing 50 g/m$^2$ at a coating weight of 6.0 g/m$^2$ and were dried. The resultant papers were treated to a smoothness of 200–300 seconds by a supercalender. The obtained black-color-forming heat sensitive recording papers were tested for their quality and performance and the test results are shown in Table 2. (Castor oil is used for contamination, instead of hair liquid).

TABLE 2

| | Image Density at 120° C. | Image Density after Contamination with Castor Oil | Residual Ratio of Image Density after the Contamination |
|---|---|---|---|
| Example of the Present Invention | 1.30 | 1.03 | 79.2% |
| Reference Example | 1.27 | 0.70 | 55.1% |

As is obvious from Table 2, the heat sensitive recording paper using biphenol A as color-developing agent is remarkable high in the residual ratio of image density after the contamination with castor oil, in comparison to the Reference Example. Therefore, the combination of p-benzyloxybenzoic acid benzylester with filler is very effective against contamination with the oily substances.

EXAMPLE 3

| | |
|---|---|
| Solution A (dispersion of dyestuff) | |
| crystal violet lactone | 1.5 parts |
| 10% aqueous solution of polyvinyl alcohol | 3.4 parts |
| water | 1.9 parts |
| Solution B (dispersion of color-developing agent) | |
| Bisphenol A (4,4'-isopropylidene diphenol | 6.0 parts |
| zinc stearate | 1.5 parts |
| 10% aqueous solution of polyvinyl alcohol | 18.8 parts |
| water | 11.2 parts |
| Solution C | |
| p-benzyloxybenzoic acid benzylester | 1.0 parts |
| 10% aqueous solution of polyvinyl alcohol | 2.5 parts |
| water | 1.5 parts |

The solutions A, B and C of the above-mentioned composition were individually ground to a particle size of 3 microns by an attritor. Then, the dispersions were mixed in the following portions to prepare the coating colors.

| COATING COLORS | Examples of the Present Invention | Reference Examples |
|---|---|---|
| Solution A | 9.1 parts | 9.1 parts |
| Solution B | 37.5 parts | 37.5 parts |
| Solution C | 5.0 parts | 0 parts |

-continued

| COATING COLORS | Examples of the Present Invention | Reference Examples |
|---|---|---|
| Kaolin Clay | 10.0 parts | 10.0 parts |

(50% aqueous dispersion)

The coating colors were applied on one side of a base paper weighing 50 g/m$^2$ at a coating weight of 6.0 g/m$^2$ and were dried. The resultant papers were treated to a smoothness of 200–300 seconds by a supercalender. The obtained blue-color-forming heat sensitive recording papers were tested for their quality and performance and the test results are shown in Table 3. (Castor oil is used for contamination.)

TABLE 3

| | Image Density* | Image Density after Contamination with Castor Oil | Residual Ratio of Image Density after the Contamination |
|---|---|---|---|
| Example of the Present Invention | 1.10 | 0.88 | 80% |
| Reference Example | 1.09 | 0.68 | 58% |

Note:
*The heat-sensitive recording sheets were recorded in a pulse width of 3.0 milliseconds and an impressed voltage of 16 volt by using the facsimile for a test (manufactured by Matsushita Electric Industrial Co., Ltd.) and optical density of recorded image was measured by the Macbeth densitometer RD-104.

As is obvious from Table 3, the heat sensitive recording paper using bisphenol A as color-developing agent and crystal violet lactone as colorless chromogenic dyestuff is remarkably high in the residual ratio of image density after the contamination with castor oil, in comparison to the Reference Example. Therefore, the combination of p-benzyloxybenzoic acid benzylester with filler is very effective against contamination with the oily substances.

EXAMPLE 4

| | |
|---|---|
| Solution A (dispersion of dyestuff) | |
| crystal violet lactone | 1.5 parts |
| 10% aqueous solution of polyvinyl alcohol | 3.4 parts |
| water | 1.9 parts |
| Solution B (dispersion of color-developing agent) | |
| Bisphenol A (4,4'-isopropylidene diphenol | 6.0 parts |
| zinc stearate | 1.5 parts |
| 10% aqueous solution of polyvinyl alcohol | 18.8 parts |
| water | 11.2 parts |
| Solution C | |
| p-benzyloxybenzoic acid benzylester | 1.0 parts |
| 10% aqueous solution of polyvinyl alcohol | 2.5 parts |
| water | 1.5 parts |

The solutions, A, B and C of the above-mentioned composition were individually ground to a particle size of 3 microns by an attritor. Then, the dispersions were mixed in the following portions to prepare the coating colors.

| COATING COLORS | Examples of the Present Invention | Reference Examples (1) | Reference Examples (2) |
|---|---|---|---|
| Solution A | 9.1 parts | 9.1 parts | 9.1 parts |
| Solution B | 37.5 parts | 37.5 parts | 37.5 parts |
| Solution C | 5.0 parts | 0 parts | 10.0 parts |

-continued

| COATING COLORS | Examples of the Present Invention | Reference Examples (1) | (2) |
|---|---|---|---|
| Aluminium-hydroxide | 10.0 parts | 10.0 parts | 0 parts |

(50% aqueous solution)

The coating colors were applied on one side of a base paper weighing 50 g/m$^2$ at a coating weight of 6.0 g/m$^2$ and were dried. The resultant papers were treated to a smoothness of 200–300 seconds by a supercalender. The obtained blue-color-forming heat sensitive recording papers were tested for their quality and performance and the test results are shown in Table 4.

TABLE 4

| | Accumulated residue on thermal head | Image density | Sticking |
|---|---|---|---|
| Example of the present invention | No trouble | 1.12 | No trouble |
| Reference Example (1) | No trouble | 0.68 | Considerable trouble (White spots in image, noise in recording) |
| Reference Example (2) | Some trouble | 1.10 | Some trouble (No white spots in image, but noise in recording) |

As is obvious from Table 4, the combination of p-benzyloxybenzoic acid benzylester and filler provides prominently better color forming properties (accumulated residue, color density and sticking) than p-benzyloxybenzoic acid benzylester or filler alone.

I claim:

1. A heat sensitive recording sheet with color-forming layer on a base sheet, characterized in that the color-forming layer comprises 3–10 parts by weight of organic color-developing agent, 1–8 parts by weight of p-benzyloxybenzoic aacid benzylester and 1–20 parts by weight of filler per 1 part by weight of a chromogenic dyestuff and 10–25 parts by weight of a binder per total solid content thereof.

2. Heat sensitive recording sheet according to claim 1, wherein said base sheet is paper.

3. Heat sensitive recording sheet according to claim 1, wherein said base sheet is film.

4. Heat sensitive recording sheet according to claim 1, wherein said organic color-developing agent is at least one substance selected from a group consisting of phenolic substance and organic acid.

5. Heat sensitive recording sheet according to claim 1, wherein said phenolic substance is at least one substance selected from a group consisting of of bisphenol A (4,4'-isopropylidene diphenol), p,p'-(1-methyl-normalhexylidene)diphenol, p-tertiary butylphenol, p-phenylphenol, Novolak phenolic resin and p-hydroxybenzoic acid esters.

6. Heat sensitive recording sheet according to claim 1, wherein said colorless or pale-colored chromogenic dyestuff is at least one substance selected from a group consisting of crystal violet lactone, 3-diethylamino-6-methyl-7-anilinofluoran, 3-(n-ethyl-p-toluidino)-6-methyl-7-anilino-fluoran, 3-diethylamino-6-methyl-7-(o,p-dimethylanilino)fluoran, 3-pyrrolidino-6-methyl-7-anilino-fluoran, 3-piperidino-6-methyl-7-anilinofluoran, 3-(n-cyclohexyl-n-methylamino)-6-methyl-7-anilino-fluoran, 3-diethylamino-7-(o-chloro-anilino)fluoran, 3-diethylamino-7-(m-trifluoromethylanilino)fluoran, 3-diethyl-amino-6-methylchlorofluoran, 3-diethyl-amino-6-methylfluoran and 3-cyclohexylamino-6-chlorofluoran.

* * * * *